US008408318B2

(12) United States Patent
Kriesels

(10) Patent No.: US 8,408,318 B2
(45) Date of Patent: Apr. 2, 2013

(54) METHOD OF EXPANDING A TUBULAR ELEMENT IN A WELLBORE

(75) Inventor: Petrus Cornelis Kriesels, Rijswijk (NL)

(73) Assignee: Shell Oil Company, Houston, TX (US)

( * ) Notice: Subject to any disclaimer, the term of this patent is extended or adjusted under 35 U.S.C. 154(b) by 293 days.

(21) Appl. No.: 12/747,009

(22) PCT Filed: Dec. 11, 2008

(86) PCT No.: PCT/EP2008/067297

§ 371 (c)(1),
(2), (4) Date: Jun. 9, 2010

(87) PCT Pub. No.: WO2009/074636

PCT Pub. Date: Jun. 18, 2009

(65) Prior Publication Data

US 2010/0276157 A1 Nov. 4, 2010

(30) Foreign Application Priority Data

Dec. 13, 2007 (EP) ..... 07123099

(51) Int. Cl.
*E21B 19/00* (2006.01)

(52) U.S. Cl. ..... 166/384; 405/184; 405/146

(58) Field of Classification Search ..... 166/384, 166/242.2, 207; 405/150.1, 184, 165, 146; 175/171, 78, 52

See application file for complete search history.

(56) References Cited

U.S. PATENT DOCUMENTS

| | | | | |
|---|---|---|---|---|
| 2007/0017669 | A1* | 1/2007 | Lurie | 166/177.4 |
| 2009/0095066 | A1* | 4/2009 | Keller | 73/152.28 |

FOREIGN PATENT DOCUMENTS

| | | |
|---|---|---|
| EP | 0044706 | 1/1982 |
| EP | 0611914 | 8/1994 |
| WO | WO9947340 | 9/1999 |
| WO | WO03036025 | 5/2003 |
| WO | WO2004020893 | 3/2004 |
| WO | WO2008006841 | 1/2008 |
| WO | WO2009053343 | 4/2009 |
| WO | WO2009056514 | 5/2009 |
| WO | WO2009065890 | 5/2009 |

* cited by examiner

*Primary Examiner* — Shane Bomar
*Assistant Examiner* — Kipp Wallace

(57) ABSTRACT

A method for radially expanding a tubular element in a wellbore formed in an earth formation comprises arranging the tubular element in the wellbore such that a lower end portion of the wall of the tubular element extends radially outward and in an axially reverse direction so as to form an expanded tubular section extending around a remaining tubular section of the tubular element. An annular space is defined between said expanded and remaining tubular sections. The expanded tubular section is axially extended by moving the remaining section downward relative to the expanded section so that said lower end portion of the wall bends radially outward and in an axially reverse direction. A tube is positioned in the annular space so that the tube extends substantially concentrically with the expanded section and is arranged to support at least one of the remaining section and the expanded tubular section.

10 Claims, 2 Drawing Sheets

METHOD OF EXPANDING A TUBULAR ELEMENT IN A WELLBORE

PRIORITY CLAIM

The present application claims priority to PCT Application EP2008/067297, filed 11 Dec. 2008, which in turn claims priority from European Application EP07123099.9, filed 13 Dec. 2007.

TECHNICAL FIELD OF THE INVENTION

The present invention relates to a method of radially expanding a tubular element in a wellbore formed into an earth formation.

BACKGROUND OF THE INVENTION

The technology of radially expanding tubular elements in wellbores finds increasing application in the industry of oil and gas production from subterranean formations. Wellbores are generally provided with one or more casings or liners to provide stability to the wellbore wall, and/or to provide zonal isolation between different earth formation layers. The terms "casing" and "liner" refer to tubular elements for supporting and stabilising the wellbore wall, whereby it is generally understood that a casing extends from surface into the wellbore and that a liner extends from a certain depth further into the wellbore. However, in the present context, the terms "casing" and "liner" are used interchangeably and without such intended distinction.

In conventional wellbore construction, several casings are installed at different depth intervals, in a nested arrangement, whereby each subsequent casing is lowered through the previous casing and therefore has a smaller diameter than the previous casing. As a result, the cross-sectional wellbore size that is available for oil and gas production, decreases with depth. To alleviate this drawback, it has become general practice to radially expand one or more tubular elements at the desired depth in the wellbore, for example to form an expanded casing, expanded liner, or a clad against an existing casing or liner. Also, it has been proposed to radially expand each subsequent casing to substantially the same diameter as the previous casing to form a monobore wellbore. It is thus achieved that the available diameter of the wellbore remains substantially constant along (a portion of) its depth as opposed to the conventional nested arrangement.

EP 1438483 B1 discloses a system for expanding a tubular element in a wellbore whereby the tubular element, in unexpanded state, is initially attached to a drill string during drilling of a new wellbore section.

To expand such wellbore tubular element, generally a conical expander is used with a largest outer diameter substantially equal to the required tubular diameter after expansion. The expander is pumped, pushed or pulled through the tubular element. Such method can lead to high friction forces between the expander and the tubular element. Also, there is a risk that the expander becomes stuck in the tubular element.

EP 0044706 A2 discloses a flexible tube of woven material or cloth that is expanded in a wellbore by eversion to separate drilling fluid pumped into the wellbore from slurry cuttings flowing towards the surface.

However there is a need for an improved method of radially expanding a tubular element in a wellbore.

SUMMARY OF THE INVENTION

In accordance with the invention there is provided a method of radially expanding a tubular element in a wellbore formed in an earth formation, the method comprising:

arranging the tubular element in the wellbore whereby a lower end portion of the wall of the tubular element extends radially outward and in axially reverse direction so as to form an expanded tubular section extending around a remaining tubular section of the tubular element, whereby an annular space is defined between said expanded and remaining tubular sections;

axially extending the expanded tubular section by moving the remaining tubular section downward relative to the expanded tubular section so that said lower end portion of the wall bends radially outward and in axially reverse direction; and positioning a tube in the annular space so that the tube extends substantially concentrically with the expanded tubular section, wherein the tube is arranged to support at least one of the remaining tubular section and the expanded tubular section.

By moving the remaining tubular section downward relative to the expanded tubular section, the tubular element is effectively turned inside out whereby the tubular element is progressively expanded without the need for an expander that is pushed, pulled or pumped through the tubular element. The expanded tubular section can form a casing or liner in the wellbore.

Furthermore, by positioning the tube in the annular space it is achieved that the tube provides collapse resistance and/or burst strength to the assembly of tube, remaining tubular section and expanded tubular section. The tubular element that is everted provides sealing functionality towards the wellbore wall or towards another tubular element arranged in the wellbore. Therefore the wall-thickness of the tubular element that is everted can be kept relatively small so that the forces required for inversion of the tubular element are relatively small.

To maintain the tube in close proximity of the lower end of the tubular element, suitably the tube is moved downward in the annular space relative to the expanded tubular section simultaneously with said downward movement of the remaining tubular section, whereby it is preferred that the speed of said downward movement of the tube is substantially equal to the speed of downward movement of said lower end portion of the wall.

Preferably the expanded tubular section is provided with outer sealing means arranged to prevent flow of formation fluid in axial direction between the expanded tubular section and the wellbore wall. In this manner the ability of the expanded tubular section to seal against the wellbore wall, or against another tubular element in the wellbore, is enhanced.

Furthermore, in order to balance fluid pressure across the wall of the expanded tubular section, it is preferred that the expanded tubular section is provided with at least one opening arranged to provide fluid communication between the exterior of the expanded tubular section and the interior of the expanded tubular section.

To further enhance the sealing functionality, suitably the expanded tubular section is provided with inner sealing means arranged to prevent flow of formation fluid in axial direction between the tube and the expanded tubular section.

To achieve that the expanded tubular section retains its expanded form, it is preferred that the wall of the tubular element includes a material that is plastically deformed in the bending zone, so that the expanded tubular section automatically remains expanded as a result of said plastic deformation. Plastic deformation refers in this respect to permanent deformation, as occurring during deformation of various ductile metals upon exceeding the yield strength of the material. Thus, there is no need for an external force or pressure to maintain the expanded form. If, for example, the expanded tubular section has been expanded against the wellbore wall as a result of said bending of the wall, no external radial force or pressure needs to be exerted to the expanded tubular section to keep it against the wellbore wall. Suitably the wall of the tubular element is made of a metal such as steel or any other ductile metal capable of being plastically deformed by eversion of the tubular element. The expanded tubular section then has adequate collapse resistance, for example in the order of 100-150 bars.

In order to induce said movement of the remaining tubular section, preferably the remaining tubular section is subjected to an axially compressive force acting to induce said movement. The axially compressive force preferably at least partly results from the weight of the remaining tubular section. If necessary the weight can be supplemented by an external, downward, force applied to the remaining tubular section to induce said movement. As the length, and hence the weight, of the remaining tubular section increases, an upward force may need to be applied to the remaining tubular section to prevent uncontrolled bending or buckling in the bending zone.

BRIEF DESCRIPTION OF THE DRAWINGS

The invention will be described hereinafter in more detail and by way of example, with reference to the accompanying drawings in which.

DETAILED DESCRIPTION OF THE PREFERRED EMBODIMENTS

Figure 1:
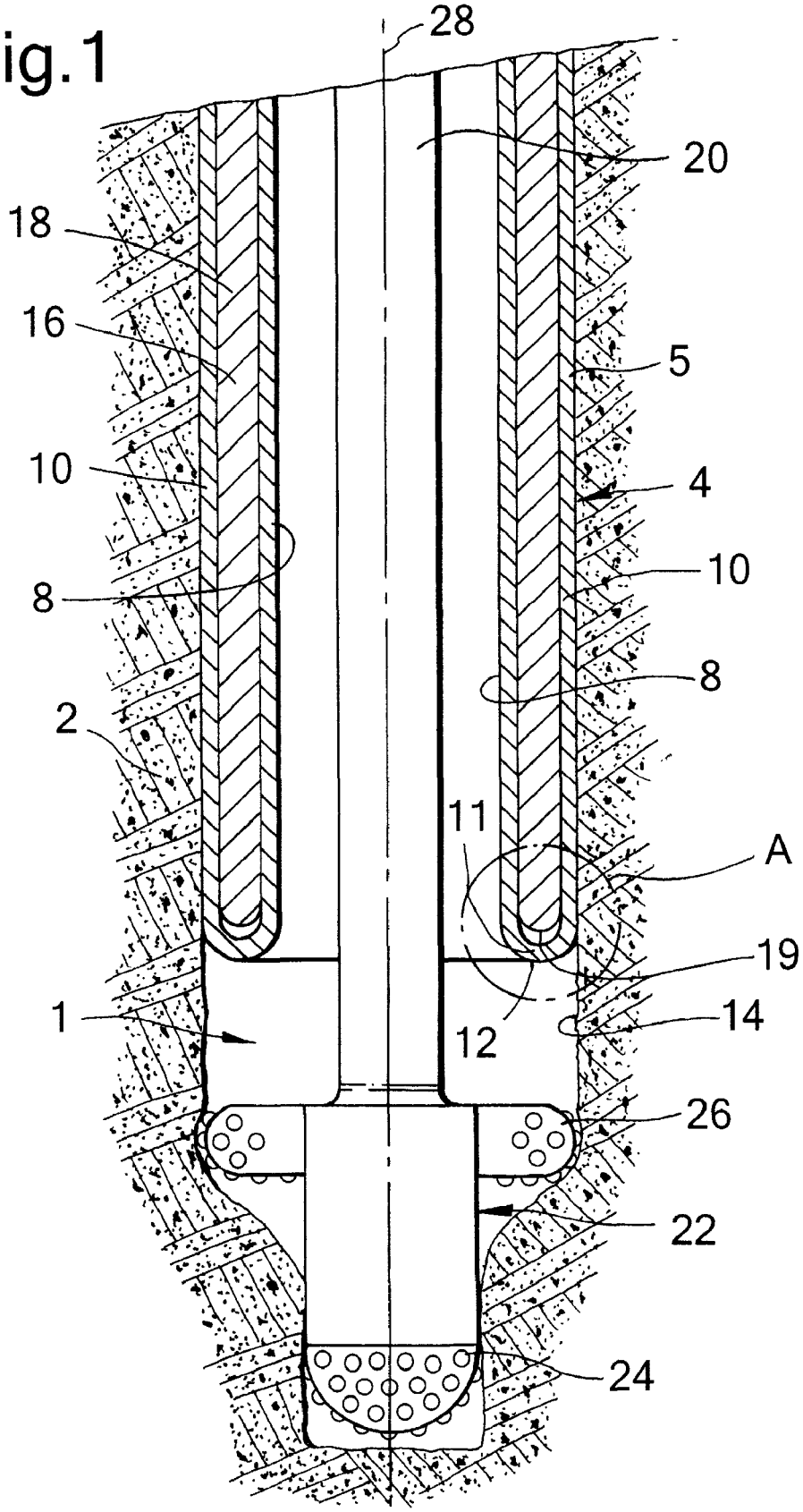
FIG. 1 schematically shows a first embodiment of a wellbore system used with the method of the invention.

In the drawings and the description, like reference numerals relate to like components.

Figure 2:
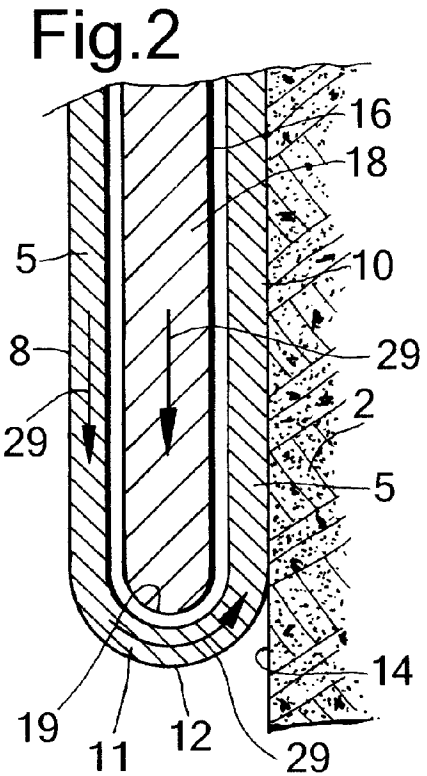
FIG. 2 schematically shows detail A of FIG. 1.

Referring to FIGS. 1 and 2 there is shown a wellbore system whereby a wellbore 1 extends into an earth formation 2, and a tubular element in the form of liner 4 extends from surface downwardly into the wellbore 1. The liner 4 has been partially radially expanded by eversion of its wall 5 whereby a radially expanded tubular section 10 of the liner 4 has been formed of outer diameter substantially equal to the wellbore diameter. A remaining tubular section of the liner 4, in the form of unexpanded liner section 8, extends concentrically within the expanded tubular section 10.

The wall 5 of the liner 4 is, due to eversion at its lower end, bent radially outward and in axially reverse (i.e. upward) direction so as to form a U-shaped lower section 11 of the wall interconnecting the unexpanded liner section 8 and the expanded liner section 10. The U-shaped lower section 11 of the liner 4 defines a bending zone 12 of the liner.

The expanded liner section 10 is axially fixed to the wellbore wall 14 by virtue of frictional forces between the expanded liner section 10 and the wellbore wall 14 resulting from the expansion process. Alternatively, or additionally, the expanded liner section 10 can be anchored to the wellbore wall by any suitable anchoring means (not shown).

The expanded tubular section 10 and the remaining tubular section 8 define an annular space 16 there between, into which a tube 18 extends whereby the tube 18 and the expanded tubular section 10 are concentrically arranged.

A drill string 20 extends from surface through the unexpanded liner section 8 to the bottom of the wellbore 1. The drill string 20 is at its lower end provided with a drill bit 22 comprising a pilot bit 24 with gauge diameter slightly smaller than the internal diameter of the unexpanded liner section 8, and a reamer section 26 with gauge diameter adapted to drill the wellbore 1 to its nominal diameter. The reamer section 26 is radially retractable to an outer diameter allowing it to pass through unexpanded liner section 8, so that the drill string 20 can be retrieved through the unexpanded liner section 8 to surface. Reference sign 28 indicates a central longitudinal axis of unexpanded liner section 8.

As shown in FIG. 2, the tube 18 extends to near the U-shaped lower section 11 of the wall of the liner 4 whereby the lower edge 19 of the tube 18 has a rounded shape substantially complementary to the shape of the U-shaped wall section 11 of liner 4. Arrows 29 indicate the respective directions of movement of the wall 5 and the tube 18 relative to the expanded liner section 10 during the eversion process.

Figure 3:
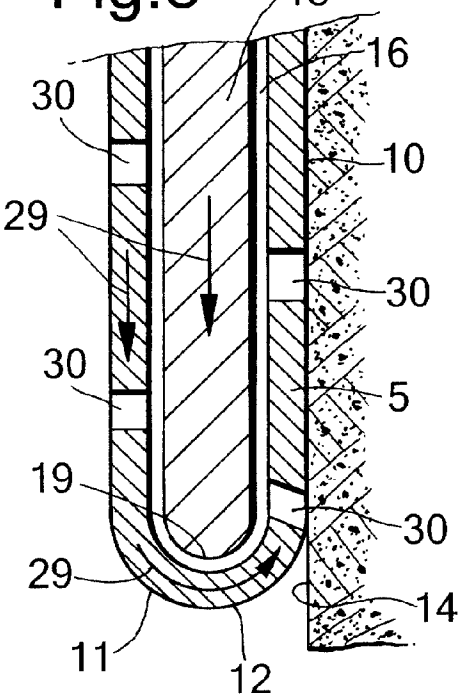
FIG. 3 schematically shows a second embodiment of a wellbore system used with the method of the invention.

Referring to FIG. 3 there is shown the lower end of liner 4 and tube 18 modified in that the wall 5 of the liner 4 has a plurality of through-openings 30. At the expanded liner section 10, the through-openings 30 provide fluid communication between the exterior and the interior of the wall 5.

Figure 4:
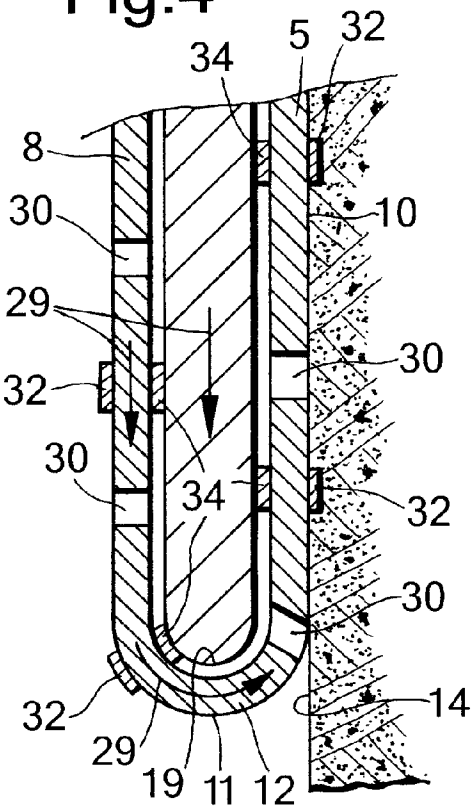
FIG. 4 schematically shows a third embodiment of a wellbore system used with the method of the invention.

Referring to FIG. 4 there is shown the lower end of liner 4 and tube 18, further modified in that the wall 5 of the liner 4 is provided with a plurality of outer annular seals 32 and inner annular seals 34 regularly spaced in axial direction. At the expanded liner section 10, the outer annular seals 32 are connected to the outer surface of the wall 5, and the inner annular seals 34 are connected to the inner surface of the wall 5. Each outer annular seal 32 prevents flow of formation fluid in axial direction between the expanded liner section 10 and the wellbore wall 14. Each inner annular seal 34 prevents flow of formation fluid in axial direction between the tube 18 and the expanded liner section 10.

During normal operation of the first embodiment (FIGS. 1 and 2), a lower end portion of the liner 4 is initially everted, that is, the lower portion is bent radially outward and in axially reverse direction. The U-shaped lower section 11 and the expanded liner section 10 are thereby initiated. Subsequently, the short length of expanded liner section 10 that has been formed is anchored to the wellbore wall by any suitable anchoring means. Depending on the geometry and/or material properties of the liner 4, the expanded liner section 10 alternatively can become anchored to the wellbore wall automatically due to friction between the expanded liner section 10 and the wellbore wall 14.

The unexpanded liner section 8 is then gradually moved downward by application of a sufficiently large downward force thereto, whereby the unexpanded liner section 8 becomes progressively everted in the bending zone 12. In this manner the unexpanded liner section 8 is progressively transformed into the expanded liner section 10. The bending zone 12 moves in downward direction during the eversion process, at approximately half the speed of the unexpanded liner section 8.

If desired, the diameter and/or wall thickness of the liner 4 can be selected such that the expanded liner section 10 becomes pressed against the wellbore wall 14 as a result of the eversion process so as to form a seal against the wellbore wall 14 and/or to stabilize the wellbore wall.

Since the length, and hence the weight, of the unexpanded liner section 8 gradually increases, the magnitude of the downward force can be gradually lowered in correspondence with the increasing weight of liner section 8. As the weight increases, the downward force eventually may need to be replaced by an upward force to prevent buckling of liner section 8.

Simultaneously with downward movement of the unexpanded liner section 8 into the wellbore, the drill string 20 is operated to rotate the drill bit 22 whereby the pilot bit 24 drills the borehole to a small diameter and the reamer section 26 enlarges the borehole to the final gauge diameter. The drill string 20 thereby gradually moves downward into the wellbore 1. The unexpanded liner section 8 is moved downward in a controlled manner and at substantially the same speed as the drill string 20, so that it is ensured that the bending zone 12 remains at a short distance above the drill bit 22. Controlled lowering of the unexpanded liner section 8 can be achieved, for example, by controlling the downward force, or upward force, referred to hereinbefore. Suitably, the unexpanded liner section 8 is supported by the drill string 20, for example by bearing means (not shown) connected to the drill string, which supports the U-shaped lower section 11. In that case the upward force is suitably applied to the drill string 20, and then transmitted via the bearing means to the unexpanded liner section 8. Furthermore, at least a portion of the weight of the unexpanded liner section 8 can be transferred to the drill string 20 by the bearing means, to provide a thrust force to the drill bit 22.

The unexpanded liner section 8 is at its upper end extended in correspondence with said downward movement.

Furthermore, simultaneously with downward movement of the unexpanded liner section 8 into the wellbore, the tube 18 is lowered into the annular space 16 at a speed substantially equal to the speed of downward movement of the U-shaped wall section 11 of the liner 4 so that the lower edge 19 of the tube 18 remains close to the U-shaped wall section 11. In this manner it is achieved that the wellbore 1 is provided with a liner during drilling. The wall 5 of expanded liner section 10 can be relatively thin relative to the wall-thickness of the tube 18 so that the forces required for eversion of liner 4 are relatively low, while the tube 18 provides collapse resistance and burst strength to the expanded liner section 10.

Normal operation of the second embodiment (FIG. 3) is substantially similar to normal operation of the first embodiment, except with regard to the following. The through-openings 30 provided fluid communication between the interior and the exterior of expanded liner section 10. Thus, in case fluid contained in the pores of the surrounding earth formation exerts a pressure to the exterior surface of the expanded liner section 10, such pressure is communicated to the interior surface of the expanded liner section 10 via the openings 30 so that a pressure balance is achieved across the wall 5. It is thereby achieved that the risk that the expanded liner section 10 becomes pressed against the tube 18 by virtue of the pore fluid pressure, thereby hampering relative movement between the expanded liner section 10 and the tube 18, is greatly reduced.

Normal operation of the third embodiment (FIG. 4) is substantially similar to normal operation of the second embodiment, except with regard to the following. Each outer annular seal 32 contributes to the sealing functionality of the expanded liner section 10 relative to the wellbore wall 14 by preventing flow of formation fluid between the expanded liner section 10 and the wellbore wall 14 past the outer annular seal. Similarly, each inner annular seal 34 prevents flow of formation fluid that enters between the tube 18 and the expanded liner section 10 via the openings 30, past inner annular seal 34.

When it is required to retrieve the drill string 20 to surface, for example when the drill bit 22 is to be replaced or when drilling of the wellbore 1 is complete, the reamer section 26 brought to its radially retracted mode. Subsequently the drill string 20 is retrieved through the unexpanded liner section 8 to surface.

With the wellbore system of the invention, it is achieved that the wellbore is progressively lined with the everted liner directly above the drill bit during the drilling process. As a result, there is only a relatively short open-hole section of the wellbore during the drilling process at all times. The advantages of such short open-hole section will be most pronounced during drilling into a hydrocarbon fluid containing layer of the earth formation. In view thereof, for many applications it will be sufficient if the process of liner eversion during drilling is applied only during drilling into the hydrocarbon fluid reservoir, while other sections of the wellbore are lined or cased in conventional manner. Alternatively, the process of liner eversion during drilling may be commenced at surface or at a selected downhole location, depending on circumstances.

In view of the short open-hole section during drilling, there is a significantly reduced risk that the wellbore fluid pressure gradient exceeds the fracture gradient of the rock formation, or that the wellbore fluid pressure gradient drops below the pore pressure gradient of the rock formation. Therefore, considerably longer intervals can be drilled at a single nominal diameter than in a conventional drilling practice whereby casings of stepwise decreasing diameter must be set at selected intervals.

Also, if the wellbore is drilled through a shale layer, such short open-hole section eliminates possible problems due to a heaving tendency of the shale.

After the wellbore has been drilled to the desired depth and the drill string has been removed from the wellbore, the length of unexpanded liner section that is still present in the wellbore can be left in the wellbore or it can be cut-off from the expanded liner section and retrieved to surface. If desired, the tube can be radially expanded slightly in conventional manner after the eversion process has been completed, to further enhance sealing of the expanded liner section towards the wellbore wall.

Further, in order to reduce axial friction between the tube on one hand and the unexpanded and expanded liner sections on the other hand, the tube can be rotated about its central longitudinal axis during the eversion process. Rotation of the tube can be continuous or in an oscillating manner. Also an axial force, either continuous or oscillating, can be exerted to the tube to overcome such axial friction forces. In a further application, the tube is subjected to pressure waves so as to cause a slight oscillation in the diameter of the tube to overcome such axial frictional forces.

In the above examples, expansion of the liner is started at surface or at a downhole location. In case of an offshore wellbore whereby an offshore platform is positioned above the wellbore, at the water surface, it can be advantageous to start the expansion process at the offshore platform. In such process, the bending zone moves from the offshore platform to the seabed and from there further into the wellbore. Thus, the resulting expanded tubular element not only forms a liner in the wellbore, but also a riser extending from the offshore platform to the seabed. The need for a separate riser from is thereby obviated.

Furthermore, conduits such as electric wires or optical fibres for communication with downhole equipment can be extended in the annulus between the expanded and unexpanded sections. Such conduits can be attached to the outer surface of the tubular element before expansion thereof. Also, the expanded and unexpanded liner sections can be used as electricity conductors to transfer data and/or power downhole.

Since any length of unexpanded liner section that is still present in the wellbore after completion of the eversion process, will be subjected to less stringent loading conditions than the expanded liner section, such length of unexpanded liner section may have a smaller wall thickness, or may be of lower quality or steel grade, than the expanded liner section. For example, it may be made of pipe having a relatively low yield strength or relatively low collapse rating.

Instead of leaving a length of unexpanded liner section in the wellbore after the expansion process, the entire liner can be expanded with the method described above so that no unexpanded liner section remains in the wellbore. In such case, an elongate member, for example a pipe string, can be used to exert the necessary downward force to the unexpanded liner section during the last phase of the expansion process.

In order to reduce friction forces between the unexpanded and expanded liner sections during the expansion process, suitably a friction-reducing layer, such as a Teflon layer, is applied between the tube and the unexpanded and expanded liner sections. For example, a friction reducing coating can be applied to the outer surface of the liner before expansion, or to the inner and/or outer surface of the tube.

Instead of expanding the expanded liner section against the wellbore wall (as explained in the detailed description), the expanded liner section can be expanded against the inner surface of another tubular element already present in the wellbore.

The invention claimed is:

1. A method of radially expanding a tubular element in a wellbore formed in an earth formation, the method comprising:

arranging the tubular element in the wellbore whereby a lower end portion of the wall of the tubular element extends radially outward and in an axially reverse direction so as to form an expanded tubular section extending around a remaining tubular section of the tubular element, whereby an annular space is defined between said expanded and remaining tubular sections;

axially extending the expanded tubular section by moving the remaining tubular section downward relative to the expanded tubular section so that said lower end portion of the wall bends radially outward and in an axially reverse direction; and positioning a tube in the annular space so that the tube extends substantially concentrically with the expanded tubular section, wherein the tube is arranged to support at least one of the remaining tubular section and the expanded tubular section wherein the wall of the tubular elements includes a material subject to plastic deformation during said bending of the wall so that the expanded tubular section retains an expanded shape as a result of said plastic deformation.

2. The method of claim 1, wherein the tube is moved downward in the annular space relative to the expanded tubular section simultaneously with said downward movement of the remaining tubular section.

3. The method of claim 2, wherein the speed of said downward movement of the tube is substantially equal to the speed of downward movement of said lower end portion of the wall.

4. The method of claim 1 wherein the expanded tubular section is provided with outer sealing means arranged to prevent flow of formation fluid in axial direction between the expanded tubular section and the wellbore wall.

5. The method of claim 1 wherein the expanded tubular section is provided with at least one opening arranged to provide fluid communication between the exterior of the expanded tubular section and the interior of the expanded tubular section.

6. The method of claim 5, wherein the expanded tubular section is provided with inner sealing means arranged to prevent flow of formation fluid in axial direction between the tube and the expanded tubular section.

7. The method of claim 1 wherein a drill string is operated to further drill the wellbore, the drill string extending through the remaining tubular section.

8. The method of claim 7, wherein the drill string and the remaining tubular section are simultaneously lowered in the wellbore.

9. The method of claim 1 wherein the remaining tubular section is subjected to an axially compressive force inducing said downward movement of the remaining tubular section.

10. The method of claim 9, wherein said axially compressive force at least partly results from the weight of the remaining tubular section.

* * * * *